US009375117B2

(12) United States Patent
Granger

(10) Patent No.: US 9,375,117 B2
(45) Date of Patent: Jun. 28, 2016

(54) DEVICE FOR DISPENSING PRE-CUT OR Z-FOLDED WIPING MATERIAL

(76) Inventor: Maurice Granger, Saint Priest en Jarez (FR)

( * ) Notice: Subject to any disclaimer, the term of this patent is extended or adjusted under 35 U.S.C. 154(b) by 150 days.

(21) Appl. No.: 13/993,036

(22) PCT Filed: Nov. 4, 2011

(86) PCT No.: PCT/FR2011/052572

§ 371 (c)(1),
(2), (4) Date: Jul. 12, 2013

(87) PCT Pub. No.: WO2012/076776

PCT Pub. Date: Jun. 14, 2012

(65) Prior Publication Data

US 2013/0277492 A1 Oct. 24, 2013

(30) Foreign Application Priority Data

Dec. 9, 2010 (FR) ..... 10 60322

(51) Int. Cl.
*A47K 10/32* (2006.01)
*A47K 10/42* (2006.01)
(Continued)

(52) U.S. Cl.
CPC ..... *A47K 10/32* (2013.01); *A47K 10/34* (2013.01); *A47K 10/424* (2013.01); *A47K 2010/3675* (2013.01)

(58) Field of Classification Search
CPC ..... A47K 10/3656; A47K 2010/3233; A47K 2010/3681; A47K 10/36; A47K 10/34; A47K 10/32; A47K 2010/3246; A47K 2010/326; A47K 2010/3675; A47K 10/3687; A47K 10/38; A47K 2010/3881; A47K 10/18; A47K 10/185; A47K 10/3827; A47K 10/42; A47K 10/424; A47K 10/44; B65D 83/08
USPC ..... 254/596, 596.4, 596.8, 598.5, 598.6, 254/579, 580, 580.1, 566, 615.3; 221/33, 221/47, 55, 62, 63
See application file for complete search history.

(56) References Cited

U.S. PATENT DOCUMENTS 1,135,658 A * 4/1915 Brown ..... 221/45
2,273,384 A 2/1942 Steiner et al.
(Continued)

FOREIGN PATENT DOCUMENTS

EP 0 034 121 B1 8/1981
EP 0 387 160 B1 9/1990
(Continued)

*Primary Examiner* — Sang Kim
*Assistant Examiner* — Nathaniel Adams
(74) *Attorney, Agent, or Firm* — Seed IP Law Group PLLC

(57) ABSTRACT

The device includes a housing with an associated cover receiving a module receiving the strip of pre-cut material, said module being provided with a transverse support plate, a flap pivotally assembled with respect to said module and to the support plate by being arranged in front of it, opposite to the inner front surface of the cover to allow the passing of the strip of material. A transverse barrier rod is arranged in the lower portion of the cover between its lateral flanges. The flap has at least one recess enabling to catch the strip of material and at least one long slot arranged in a plane forming an angle from the lower edge of the flap, said slot defining an area for receiving at least one rib formed in a complementary configuration on the cover by penetrating on closing of the cover into said slot. The cover has at least one rib adapting in the slot formed on the flap and at least one recess for the passing of the strip of material. The rib(s) formed on the cover have a tear drop configuration with a progressive height from their base inside of the cover to the lower end thereof, and the rib(s) have in their upper portion a rounded shape having the function of allowing the separability of a format of pre-cut strip of material from the rest of the strip.

16 Claims, 7 Drawing Sheets

Figure 1:
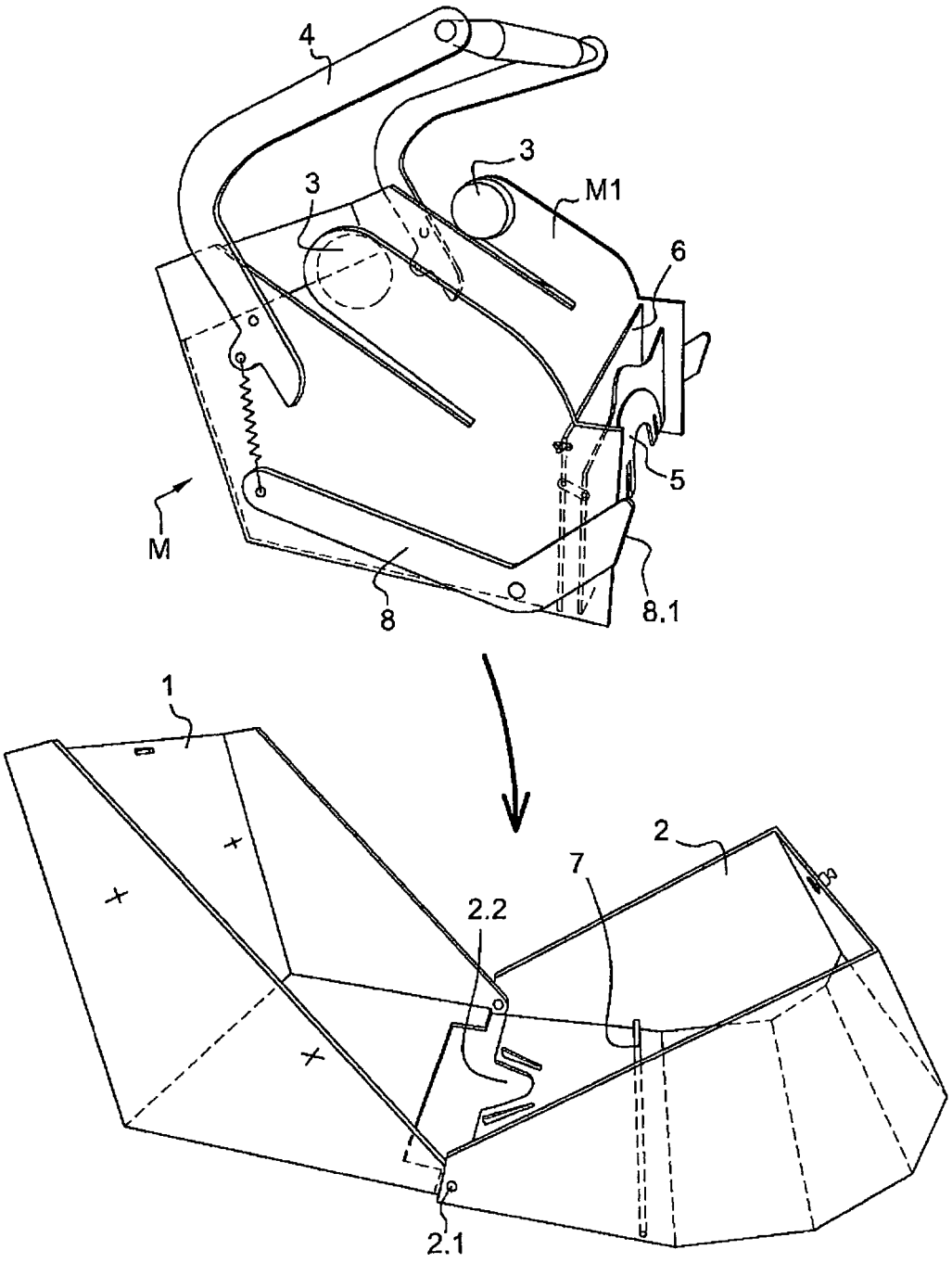

(51) Int. Cl.

| | |
|---|---|
| ***A47K 10/34*** | (2006.01) |
| *A47K 10/36* | (2006.01) |

(56) References Cited

U.S. PATENT DOCUMENTS

| | | | | | |
|---|---|---|---|---|---|
| 2,590,718 | A | | 3/1952 | Lundquist | |
| 2,683,641 | A | | 7/1954 | Larson | |
| 2,695,208 | A | * | 11/1954 | Graham | A47K 10/3827 225/33 |
| 4,165,138 | A | | 8/1979 | Hedge et al. | |
| 4,389,026 | A | | 6/1983 | Willa et al. | |
| 4,467,974 | A | | 8/1984 | Crim | |
| 4,611,768 | A | * | 9/1986 | Voss | A47K 10/3687 242/564.2 |
| 5,207,633 | A | | 5/1993 | Granger | |
| 5,335,811 | A | * | 8/1994 | Morand | 221/45 |
| 5,897,074 | A | * | 4/1999 | Marino | A47K 10/38 242/594.1 |
| 6,202,956 | B1 | | 3/2001 | Grasso et al. | |
| 6,736,348 | B1 | * | 5/2004 | Formon et al. | 242/560.1 |
| 7,040,567 | B1 | | 5/2006 | Lewis et al. | |
| 7,093,737 | B2 | * | 8/2006 | Tramontina | B65D 83/0817 221/198 |
| 8,191,736 | B2 | | 6/2012 | Beranger | |
| 8,672,255 | B2 | | 3/2014 | Granger | |
| 2010/0001015 | A1 | | 1/2010 | Thoren et al. | |
| 2011/0089213 | A1 | * | 4/2011 | Granger | 225/106 |
| 2011/0101020 | A1 | * | 5/2011 | Granger | A47K 10/424 221/45 |
| 2011/0174833 | A1 | | 7/2011 | Granger | |
| 2011/0284681 | A1 | | 11/2011 | Granger | |
| 2013/0256450 | A1 | | 10/2013 | Granger | |
| 2013/0277492 | A1 | | 10/2013 | Granger | |
| 2013/0320132 | A1 | * | 12/2013 | Granger | 242/590 |
| 2013/0334272 | A1 | * | 12/2013 | Granger | 225/15 |

FOREIGN PATENT DOCUMENTS

| | | | | | |
|---|---|---|---|---|---|
| FR | 957 096 | | | 10/1947 | |
| FR | 1 060 322 | | | 4/1952 | |
| FR | 1 058 449 | | | 3/1954 | |
| FR | 1 058 471 | | | 3/1954 | |
| FR | 1 059 244 | | | 3/1954 | |
| FR | 2 931 350 | A1 | | 11/2009 | |
| FR | 2932671 | A1 | * | 12/2009 | A47K 10/424 |
| FR | 2 960 760 | A1 | | 12/2011 | |
| FR | 2 966 034 | A1 | | 4/2012 | |
| FR | 2 968 530 | A1 | | 6/2012 | |
| FR | 2 970 167 | A1 | | 7/2012 | |
| FR | 2 983 694 | A1 | | 6/2013 | |
| WO | 2009/150342 | A2 | | 12/2009 | |
| WO | 2009/150351 | A1 | | 12/2009 | |
| WO | 2010/007261 | A1 | | 1/2010 | |
| WO | 2010/034915 | A1 | | 4/2010 | |
| WO | 2010/063917 | A1 | | 6/2010 | |
| WO | 2010/089467 | A1 | | 8/2010 | |

* cited by examiner

Fig. 6
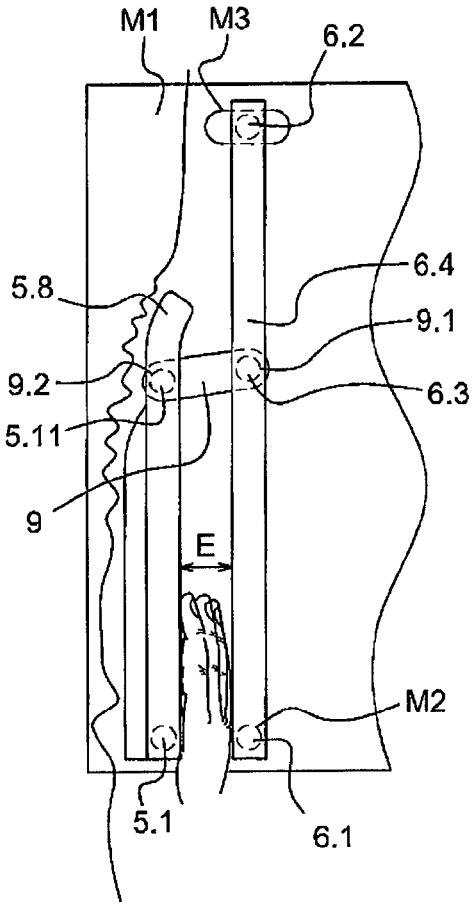
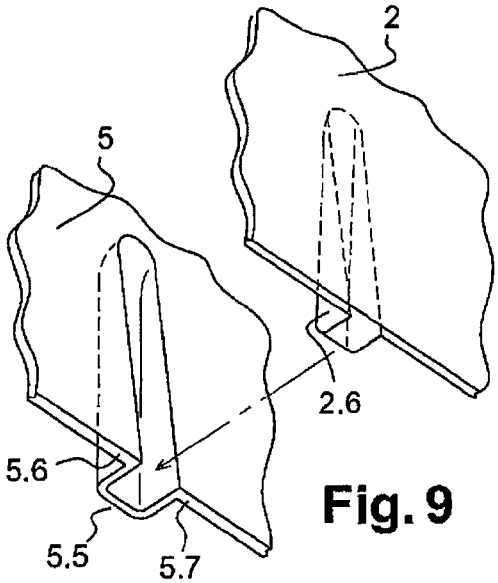
Fig. 9
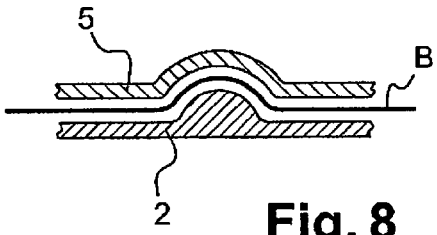
Fig. 8
Fig. 7
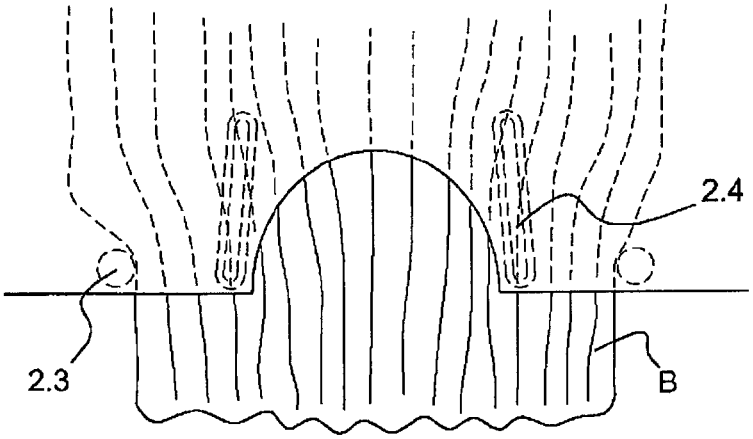

DEVICE FOR DISPENSING PRE-CUT OR Z-FOLDED WIPING MATERIAL

The present disclosure relates to the technical field of devices for dispensing wiping materials of soft tissue type, such as hand wipes, toilet paper, and for general wiping and cleaning applications.

The Applicant has already worked on dispensers providing pre-cut wiping material. Different technical solutions have thus been provided, which have been described in patents WO 2010/089467, WO 2010/063917, WO 2010/034915, WO 2010/007261, WO 2009/150342.

Patent WO 2010/089467 has had a complementary development in French patent FR 1058449 with, in particular, the provision of a cover capable of being raised to close the device, and comprising a device for unjamming the strip of pre-cut material.

This last device is of the type comprising a housing directly or indirectly receiving the pre-cut wiping material intended to be dispensed. This housing, of parallelepipedal shape, receives a closing cover which may be hinged to be opened or closed by its being raised upwards and then locked. Such a housing may be fitted with a module for receiving the material. Such a module thus comprises a front transverse support wall for receiving different means. The strip of material is guided in any appropriate manner by the module, to be conveyed to the device outlet between the front wall and the opposite surface of the cover. The module is capable of having a flap hinged with respect to the set-back support plate. The flap is arranged directly opposite to the internal surface of the cover, with the material passing in the space between the two. In this specific configuration, the issue used to be the maintaining of the wiping material flat as it is dispensed. This means that the wiping material should not be folded or creased, so that it remains flat all throughout its surface.

The Applicant has, in such conditions, designed and developed a technical solution disclosed in French patent application FR 1058471. According to this application, the device for dispensing a rolled or folded pre-cut wiping material comprises a housing with an associated cover raised from the top. The housing receives a module capable of being quickly assembled and removed receiving the pre-cut strip of material. The module is provided with a transverse support plate capable of receiving small shaped plates capable of resiliently pivoting. A flap is pivotally assembled with respect to said module and to the support plate by being arranged in front of it and opposite to the inner front surface of the cover, to allow the passing of the strip of material. The flap, the small plates, and the cover are fitted with means enabling to dispense the pre-cut strip of material in such a way that it remains flat.

In French patent application FR 1058471, a pivoting flap which is fitted on its edges with swivel axes to enable it to pivot towards the back is arranged at the front of the module. The flap is intended to be opposite to the inner surface of the cover on closing thereof, while leaving a space to let the strip of material pass therebetween. The flap has a specific configuration with a central cutout area of trapezoidal configuration, extending at its end in a staged portion, itself having rounded ends. An intermediate horizontal portion is placed between the bottom of the central recess and the lower end of the flap. Two support points are thus formed at the end of the trapezoidal recess and of the horizontal junction plane, having a function which will be specified hereafter.

The module further comprises a transverse support plate also stiffening the module. This support plate is especially intended to receive small shaped plates which are capable of slightly protruding from the lower end of the flap. The small plates are fastened by their upper end to the support plate and are capable of resiliently pivoting against pull-back means. Two small plates are thus arranged and are located on either side of the trapezoidal opening located in the median plane of the flap. The small plates protrude from the flap in its lower portion and they are each fitted with at least one, and preferably two obliquely-arranged tongues. These pairs of tongues face outwards with respect to the trapezoidal cutout of the flap.

In the context of French patent application FR 1059244, the cover is fitted with a transverse barrier rod arranged in the lower portion of said cover between its lateral flanges. The barrier rod is located, on raising of the cover, in a plane higher than the upper portion of the flap and in a set-back plane. The cover has a central recess with, on either side, hollow patterns for cooperating with matching shapes formed on the flap. The pivoting flap has a central area with flat portions interconnected by vertical connection strips providing a curved configuration. Said flap has a second area formed by an upper band curved with respect to the portions in an inward-directed plane. The flap has a third area in its lower portion provided with a central recess continued by connection walls comprising protruding means cooperating with the hollow patterns formed on the cover, and boss-shaped means receiving stop axes for cooperating with stop pads arranged on the support plate.

Within the framework of his research, the Applicant has desired to further optimize the design of the dispenser of rolled or Z-folded pre-cut wiping material while simplifying the components thereof.

According to a first feature of the invention, the device for dispensing a rolled or folded pre-cut wiping material comprising a housing with an associated cover closed by being raised upwards, said housing receiving a module receiving the strip of pre-cut material, said module being provided with a transverse support plate, a flap pivotally assembled with respect to said module and to the support plate by being arranged in front of it, opposite to the inner front surface of the cover to allow the passing of the strip of material, the flap and the cover being provided with means enabling to dispense the strip of pre-cut material in flat condition, the cover being provided with a barrier rod located, in raised and closed position of the cover, in a plane higher than the upper portion of the flap and in a set-back plane to allow the passing of the strip of material, the flap and the cover each having at least one recess enabling to catch the strip of material, is remarkable in that it comprises a housing associated with the cover and receiving the module capable of being rapidly assembled and removed, and in that the transverse barrier rod is arranged in the lower portion of the cover between its lateral flanges, and in that the flap has at least one recess enabling to catch the strip of material and at least one long slot arranged in a plane forming an angle from the lower edge of the flap, said slot defining an area for receiving at least one rib formed in a complementary configuration on the cover by penetrating, on closing of the cover, into said slot, and in that the cover has at least one rib adapting in the slot formed on the flap and at least one recess for the passing of the strip of material, and in that at least the rib formed on the cover has a tear drop configuration with a progressive height from its base inside of the cover to the lower end thereof, and in that the rib has in its upper portion a rounded shape having the function of allowing the separability of a format of pre-cut strip of material from the rest of the strip.

According to another feature, the flap has on either side of its central recess two long slots arranged to form an angle from the lower edge of the flap, and said slots define an area for receiving two ribs formed in a complementary configuration on the cover by penetrating, on closing of the cover, into said slots, and said ribs formed on the cover have a tear drop configuration with a progressive height from their base inside of the cover to the lower end thereof, and the ribs have in their upper portion a rounded shape having the function of allowing the separability of a format of pre-cut strip of material from the rest of the strip.

According to another feature, the flap has in its lower central portion a slot arranged to form an angle from the lower edge of the flap and, on either side of said slot, two identical opposite recesses for catching the strip of material, and the cover has in its central portion a rib arranged to form an angle with respect to the lower border of the cover and, on either side, two recesses for catching the strip of material and matching the recesses formed on the flap.

Figure 2:
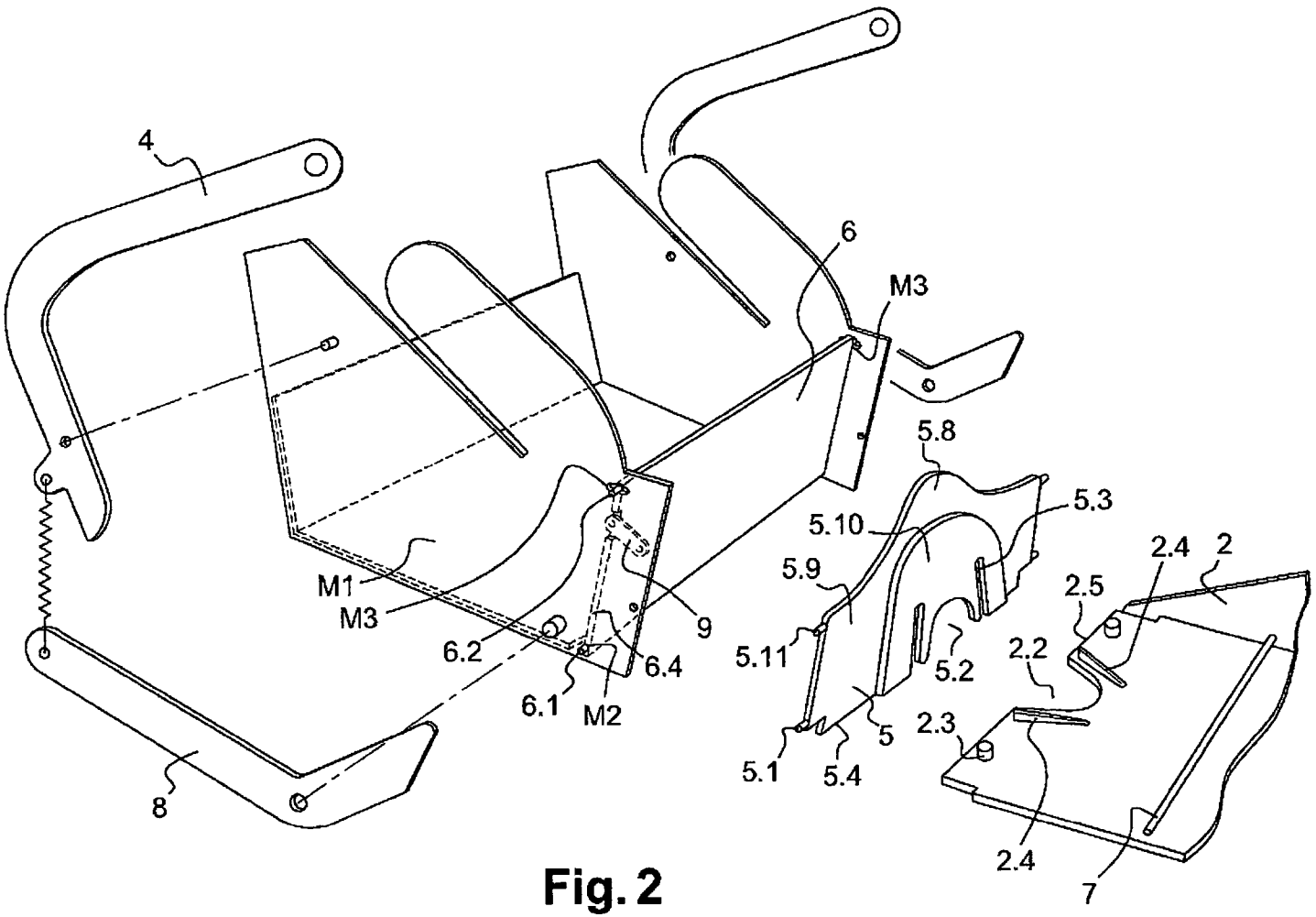
Figure 3:
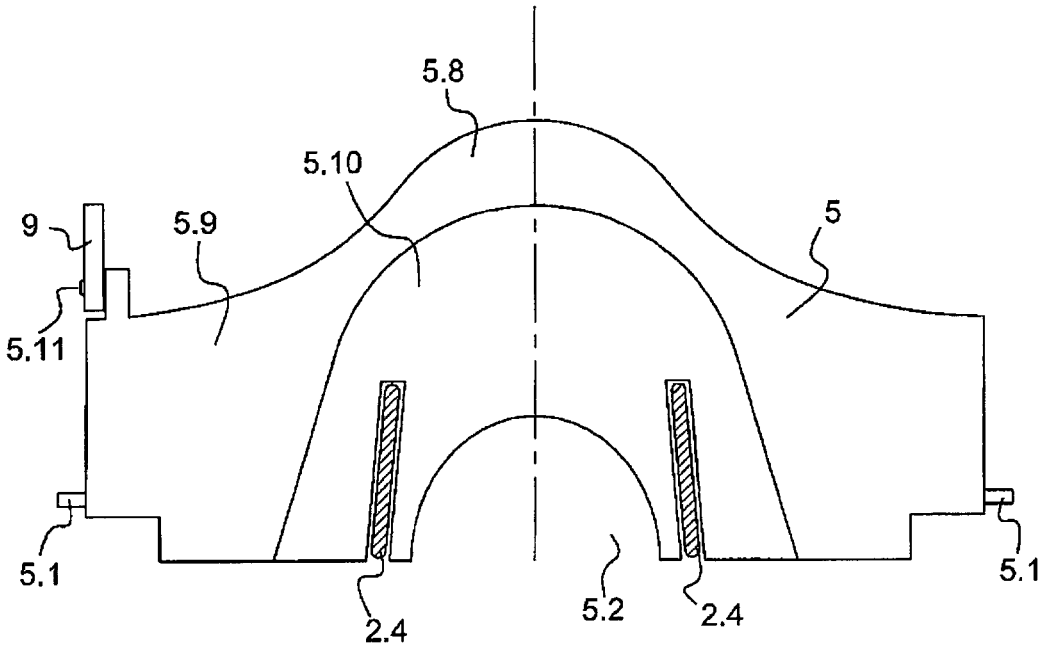
Figure 4:
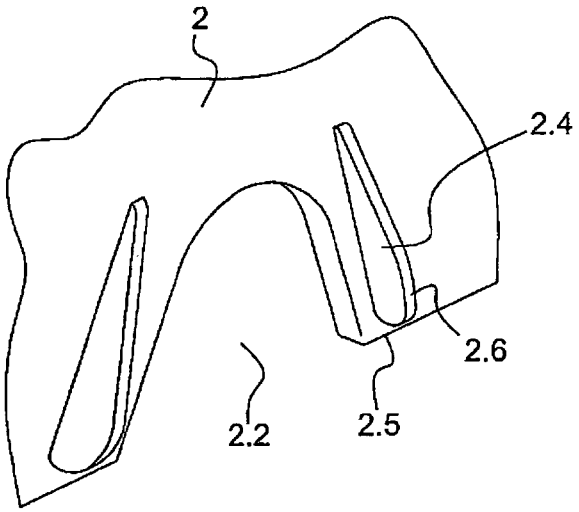
Figure 5:
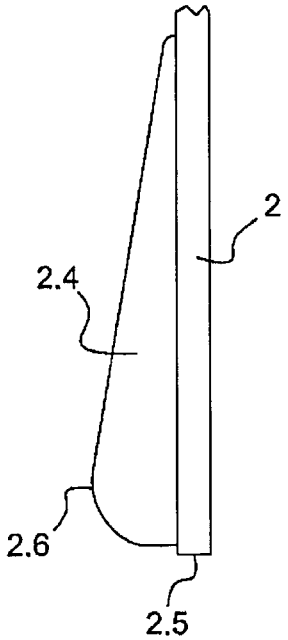
Figure 10:
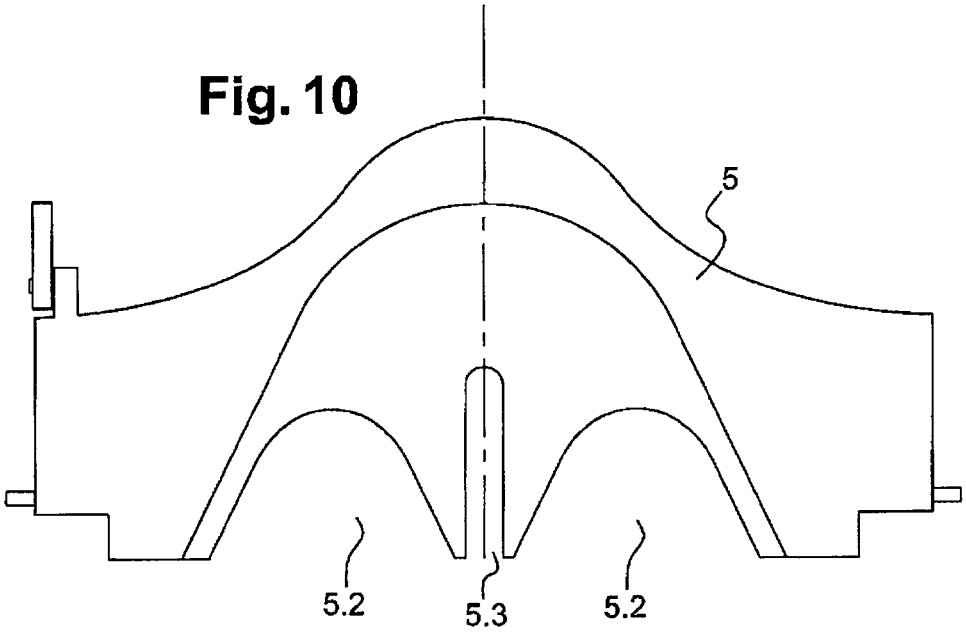
Figure 11:
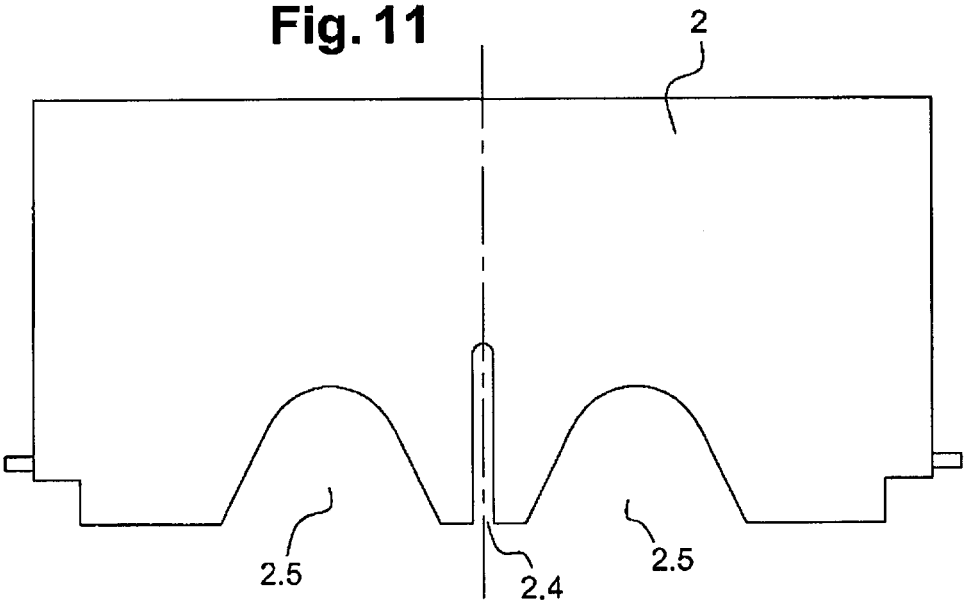
Figure 12:
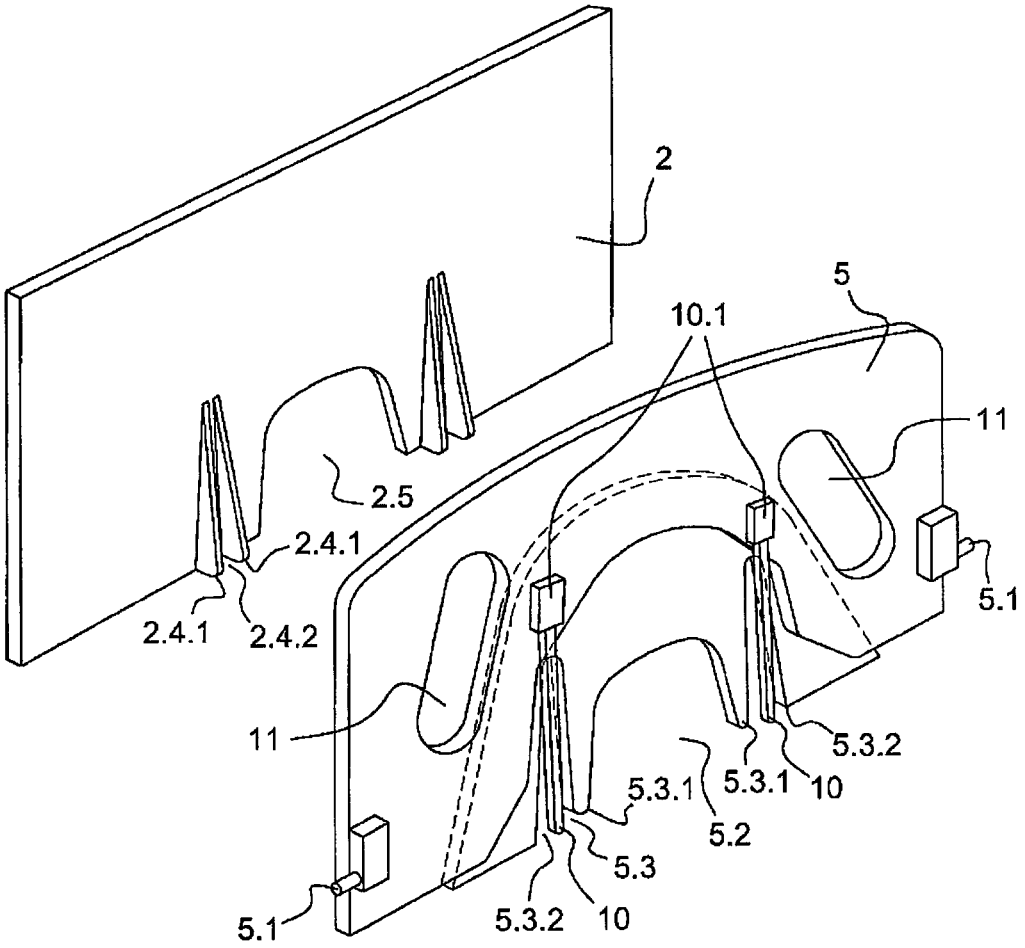
Figure 13:
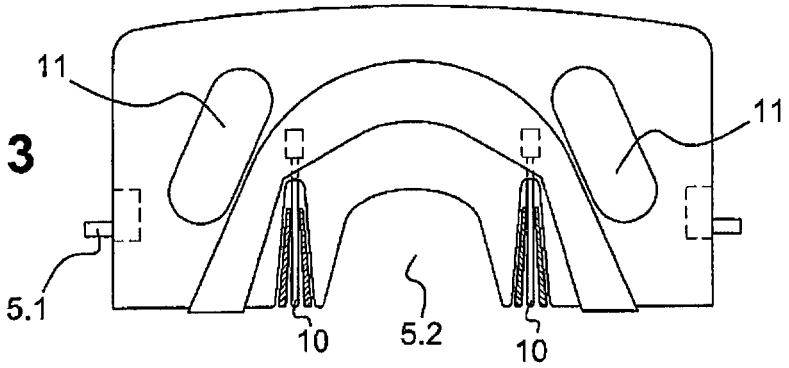
Figure 14:
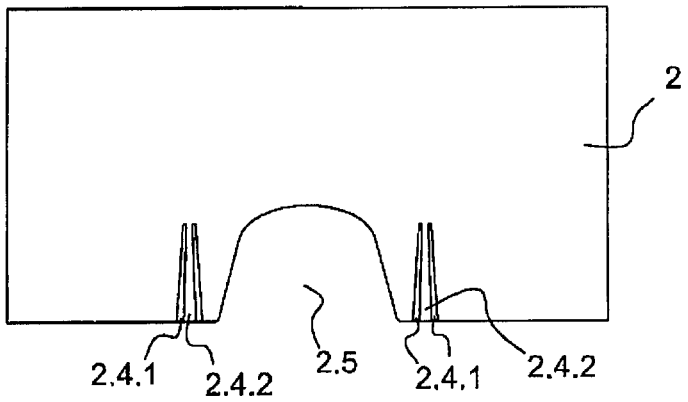
Figure 15:
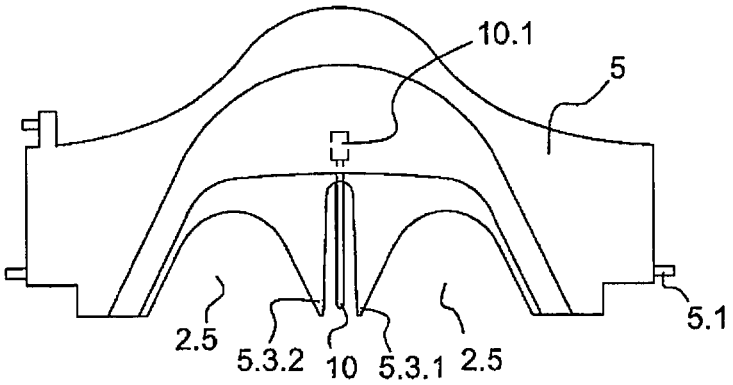
Figure 16:
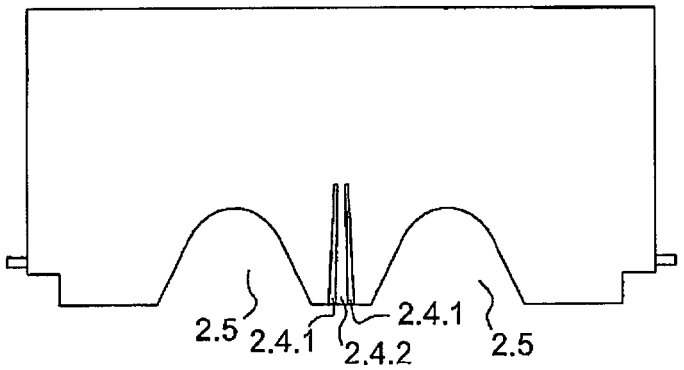

The object of the invention is non-limitingly illustrated in the drawings, where:

FIG. 1 is a perspective view of the pre-cut wiping material dispenser with its module before being integrated in the housing-cover assembly, FIG. 2 is a perspective view before assembly of the module, the cover and the flap being assembled separately, FIG. 3 is a partial front view of the flap with ribs formed on the cover shown in hatchings, FIG. 4 is a partial view showing the inner side of the cover with said ribs, FIG. 5 is a side view of ribs formed on the cover according to FIG. 4, FIG. 6 is a partial side view of the module showing the hinged flap and the hinged transverse plate, FIG. 7 is a view showing the outlet of the strip of material, FIG. 8 is a partial view illustrating the penetration of the strip of material between the ribs formed on the cover and the slot formed on the flap, FIG. 9 is an alternative view illustrating the configuration of the flap around the slot, FIG. 10 is an alternative view of the flap with a single slot and two recesses, FIG. 11 is a view complementary to FIG. 10 of the cover with one rib and two recesses, FIG. 12 is an alternative view illustrating the configuration of the flap and of the opposite portion of the cover in the arrangement of the respective complementary rib and slot shapes, FIGS. 13 and 14 are planar views of the flap and of the cover portion in the configuration of FIG. 12, FIGS. 15 and 16 are planar views of the flap and of the cover in an alternative configuration in relation with FIGS. 10 and 11 but with a presentation of the means forming the rib and the slot with two recesses on either side.

To make the object of the invention more tangible, it is now described in a non-limiting way illustrated in the drawings.

The pre-cut wiping material dispenser is designated with general reference (A). It comprises a housing (1) with an associated cover (2). The cover (2) is hinged on axes (2.1) of the housing to be raised upwards for its closing and locking. The housing receives a module (M) which is attached thereto by quick assembly/removal means. This module may be arranged to enable to dispense the pre-cut strip of material in a roll configuration. For this purpose, it comprises a swivel system (4) which enables to stretch the strip of material, the roll being arranged on end pieces (3) formed on the lateral flanges (M1) of the module. The module may be provided in its rear portion with a reservoir for storing a pre-cut roll of material or to store a roll end.

In another configuration, the pre-cut strip of material appears in folds and the module forms with its rear portion a reservoir for storing the pile formed by the strip of material.

In both cases, the swivel mechanism enables to guide and to stretch the strip of material.

Reference numeral (5) designates a pivoting flap located at the front of the module and provided on its edges with swivel axes (5.1) to enable it to pivot towards the back.

Reference numeral (6) designates the front transverse support plate of the module arranged between the lateral flanges thereof.

The cover (2) is provided with a transverse barrier rod (7) in its lower portion between the lateral flanges so that on raising of the cover, said barrier rod is located in a plane higher than the upper portion of the flap (5) and in a slightly set-back plane to allow the passage of the strip of material. The cover has a substantially trapezoidal central recess (2.2) and has, at its ends, stops (2.3) for guiding the strip of material. The module further comprises bent levers (8) arranged on either side of the module, outside thereof, and hinged with respect to the module flanges. Such bent levers are resiliently connected to the swivel system (4). The levers have, at their ends, bearing faces (8.1) cooperating with the cover on closing thereof.

According to the invention, the device has complementary means taking part in the optimization of the operation for the dispensing of the rolled or folded pre-cut strip of material.

According to a first arrangement, in a first alternative embodiment, the flap (5) has, on either side of its central recess (5.2), two long slots (5.3) arranged perpendicularly from the lower edge (5.4) of the flap. These slots formed across the flap thickness have a length of several centimeters—approximately ranging from 3 to 5 cm, and preferably 4 cm—and are arranged to be parallel or preferably substantially oblique with respect to each other, being closer to each other in the upper portion of the flap. The slots thus define an area for receiving two ribs (2.4) formed in a complementary configuration on the cover (2) by penetrating, on closing of the cover, into said slots (5.3). Such ribs thus have a length substantially smaller than the length of the slots (5.3) to enable them to engage therein. Further, the slot width is greater than the thickness of the ribs to enable a free introduction of said ribs into the slots while allowing the passing of the pulled strip of material. The ribs are formed on the cover and preferably have a tear drop configuration with a progressive height from their base inside of the cover to the lower end (2.5) thereof. The ribs, in the lower portion, have a height approximately ranging from 1 to 2 cm and preferably on the order of 1.5 cm with a rounded shape (2.6). Such rounded shapes, formed on each rib, have the specific function of promoting the separability of a format of a strip of pre-cut material from the rest of the strip.

Further, the slots (5.3) formed on the flap may run all the way to the low portion of the flap, but a bridge shape (5.5) connecting the two flap ends (5.6) (5.7) adjacent to the corresponding slot to stiffen the assembly and avoid any breakage at the location of a weakened area is advantageously formed.

According to another arrangement, the flap (5) has in its upper portion in its central area an inward-curved shape (5.8) to ease the presentation of the beginning of the strip of material. This area then extends on each side by junction (5.9) and connection portions.

According to another arrangement, the flap (5) has on its outer apparent surface a rainbow-shaped bulged area (5.10) to ease the passing and the unwinding of the strip of material (B).

According to another arrangement of the invention, the transverse plate (6), located at the front of the module, is assembled in a novel manner with the ability to pivot from front to back, in close collaboration with the flap (5). For this purpose, the plate (6) has in its lower portion swivel axes (6.1) penetrating into openings (M2) formed on the module flanges. Each flange (M1) of the housing has a substantially horizontal or slightly curved slotted port (M3) which allows the passing of a finger (6.2) formed to overlap the upper border of the plate (6). The connection between the flap (5) and the plate (6) is performed via a connecting rod (9) which is provided with two openings (9.1) (9.2) arranged at its end and respectively enabling to position a second guide finger (6.3) formed on one of the edges (6.4) of the transverse plate, as well as a hook shape (5.11) formed from one of the lateral sides of the flap.

In practice, in this configuration, the hinging of the transverse plate (6) with respect to the flap (5) is essentially performed when the strip of material has to be unjammed. In practice, space (E) formed between the flap (5) and the transverse plate (6) is sufficient to allow the passing of the operator's hand so that with one or several of his fingers, he can grab the jammed strip of material and pull it to suppress the jamming.

Referring to FIGS. 10 and 11 in another variation, the flap (5) has a single slot (5.3) arranged in the lower central portion of said flap and, on either side thereof, two identical opposite recesses (5.2) to enable to grab the strip of material. The other arrangements of the flap (5) are kept. Further, the flap (2) is complementarily provided with a single rib (2.4) of identical configuration and two recesses (2.5) provided on either side of the rib. The other arrangements remain unchanged.

Such a simplified embodiment of the device enables to decrease the number of components and assembly costs, while facilitating the use for the dispensing of strips of material.

FIGS. 12 to 16 show an alternative embodiment where the ribs (2.4) formed on the cover are in a specific configuration comprising two fins (2.4.1) having the same configuration as previously described, but arranged in oblique directions with respect to each other, being closer to each other at the lower end located in the inner portion of the cover. Such ribs define together a progressive passage (2.4.2) enabling to insert complementary tooth-shaped means (10) formed on the flap. The rib(s) thus formed are thus arranged according to the selected configuration of the cover, with one or two recesses (2.5), as shown in the drawings. Parallel thereto and complementarily, flap (5) has a slot (5.3) of complementary shape, oblique with respect to the opposite faces (5.3.1) (5.3.2). They enable to receive the previously-mentioned rib configuration (2.4.1). Further, tooth-shaped means (10) formed from the flap are positioned above the space formed on the slot (5.3) and penetrate into the space (2.4.2) formed between the portions (2.4.1.) of rib (2.4). The base (10.1) of the tooth shape is in the central plane of the flap.

The pulled strip of material will thus pass in the space formed on assembly and interlocking of the rib and slot portions when the cover is raised, to face the previously-mentioned flap. Such a configuration enables to dispense the strip of material in the best conditions.

According to another embodiment of the invention as shown, for example, in FIGS. 12 and 13, the flap has two slotted openings (11) obliquely arranged, which enable the passing of the user's fingers in the conditions illustrated, for example, in FIG. 6. This provides the user an easier access to the strip of material in order to unjam it.

By the specific configuration of the flap and of the cover, and by the interlocking of the strip of material at the location of the slots and ribs, the strip of material remains in an uncreased state.

The invention claimed is:

1. A device for dispensing a rolled or folded pre-cut wiping material comprising:

a cover movable to a closed position by being raised upwards;

an element configured to receive a strip of pre-cut material, the element having a transverse support plate;

a flap pivotally mounted relative to said element and to the transverse support plate, the flap arranged between the transverse support plate and an inner front surface of the cover to define a gap through which the strip of pre-cut material passes;

a transverse barrier rod arranged in a lower portion of the cover between lateral flanges of the cover, a space being defined between the transverse barrier rod, the lateral flanges, and a lower wall of the cover for passing of the strip of pre-cut material when the cover is in the closed position, and wherein:

the flap has at least one recess configured to provide access to the strip of pre-cut material and the cover has at least one recess configured for passing of the strip of pre-cut material;

the element is a module received by a housing associated with said cover;

the flap has at least one slot extending from a lower edge of the flap in a direction that is generally linear; and the cover has at least one rib located on an interior side thereof, the at least one rib having a base end and a lower end, the at least one rib extending from the base end to the lower end and having an upper portion with a rounded shape located proximal to the lower end than to the base end, the at least one rib projecting outwardly from an interior surface of the cover in a direction that is generally normal to the interior surface to define a variable height that progressively increases from the base end to the lower end, said at least one slot of the flap defining a reception area when the cover is in the closed position for receiving therein said at least one rib formed in a complementary configuration on the cover.

2. The device of claim 1, wherein the flap has on either side of the at least one recess two slots arranged angularly with respect to the lower edge of the flap in directions that are generally linear, the slots define an area for receiving two ribs formed in a complementary configuration on the cover, the ribs penetrating into said slots on closing of the cover, each of the two ribs having a base end and a lower end, the rib extending from the base end to the lower end and having an upper portion with a rounded shape located proximal to the lower end than to the base end, each of the two ribs projecting outwardly from the interior surface in a direction that is generally normal to the interior surface to define a variable height that progressively increases from the base end to the lower end, the rounded shapes of the ribs being configured to allow separability of one form of a strip of pre-cut material from the rest of the strips of pre-cut material.

3. The device of claim 1, wherein the slot is arranged to form an angle from the lower edge of the flap and is located in a lower central portion of the flap and, on either side of said slot, the flap includes two identical opposite recesses for catching the strip of pre-cut material; and the rib is arranged to form an angle with respect to a lower border of the cover and is located in a central portion of the cover and, on either side of said rib, the cover includes two recesses for catching the strip of pre-cut material which match the recesses formed on the flap.

4. The device of claim 1, wherein the slots are formed across a thickness of the flap and have a length ranging from 3 to 5 cm.

5. The device of claim 1, wherein the rib has a length substantially smaller than a length of the slot, and a width of the slot is greater than a thickness of the rib so that the rib is received in the slot while allowing the passing of the pulled strip of pre-cut material.

6. The device of claim 1, wherein the rib has a maximum height approximately ranging from 1 to 2 cm.

7. The device of claim 1, wherein the slot is formed in a lower portion of said flap.

8. The device of claim 1, wherein the slot formed on the flap partially extends through a thickness of the flap and includes a bridge shape portion which connects two flap ends adjacent to the slot.

9. The device of claim 1, wherein the flap includes a pair of slots arranged to be substantially oblique with respect to each other, the slots being closer to each other in an upper portion of the flap.

10. The device of claim 1, wherein an upper portion of the flap includes a central portion with an inward-curved shape.

11. The device of claim 1, wherein the flap includes a rainbow-shaped bulged area projecting from an outer surface of the flap.

12. The device of claim 1, wherein the transverse plate is located at a front of the module when the device is in an assembled configuration, the transverse plate being configured to be pivotably rotatable from the front of the module to a rear of the module in collaboration with the flap.

13. The device of claim 12, wherein the transverse plate includes swivel axes located in a lower portion thereof, the swivel axes penetrating into openings formed on flanges of the module, each flange having a slotted port which allows the passing of a finger extending from an upper border of the transverse plate, and wherein the flap and the transverse plate are connected via a connecting rod which is provided with two openings arranged at opposing ends thereof, wherein one of the openings is configured to receive a second guide finger extending from an edge of the transverse plate and the other opening is configured to receive a hook shape extending from a lateral side of the flap.

14. The device of claim 1, wherein the at least one rib formed on the cover includes two fins obliquely arranged with respect to each other, the fins being closer to each other at a lower end located in an inner portion of the cover, the fins define together a passage configured to receive a complementary tooth formed on the flap, and the flap includes the slot which is formed of a shape complementary to the fins and oblique with respect to opposing faces of the slot, the slot configured to receive the fins.

15. The device of claim 14, wherein the tooth is positioned above a space formed on the slot and penetrates into the passage formed between the fins, and a base of the tooth is in a central plane of the flap.

16. The device of claim 1, wherein the flap has two slotted openings obliquely arranged, the two slotted openings enabling a user to pass the user's fingers between the flap and the transverse plate.

* * * * *